US010267073B2

(12) United States Patent
Reichlyn

(10) Patent No.: US 10,267,073 B2
(45) Date of Patent: Apr. 23, 2019

(54) WASHING MACHINE DEVICE

(71) Applicant: Shepard Banks Investments LLC, Mount Pleasant, SC (US)

(72) Inventor: Ryan Reichlyn, Carlsbad, CA (US)

(73) Assignee: Shepard Banks Investments LLC, Mount Pleasant, SC (US)

( * ) Notice: Subject to any disclaimer, the term of this patent is extended or adjusted under 35 U.S.C. 154(b) by 94 days.

(21) Appl. No.: 15/691,088

(22) Filed: Aug. 30, 2017

(65) Prior Publication Data

US 2019/0063126 A1 Feb. 28, 2019

(51) Int. Cl.

| | |
|---|---|
| ***D06F 39/14*** | (2006.01) |
| ***E05C 17/12*** | (2006.01) |
| ***E05C 17/08*** | (2006.01) |

(52) U.S. Cl.

CPC ..... *E05C 17/12* (2013.01); *D06F 39/14* (2013.01); *E05C 17/08* (2013.01); *E05Y 2900/312* (2013.01)

(58) Field of Classification Search

CPC ..... D06F 39/14

See application file for complete search history.

(56) References Cited

U.S. PATENT DOCUMENTS

2011/0006170 A1* 1/2011 Liu ..... F16M 11/041 248/121

2011/0279004 A1* 11/2011 Assmann ..... A47L 15/4259 312/228

2012/0032569 A1* 2/2012 Hill ..... D06F 39/12 312/228

OTHER PUBLICATIONS

Laundry Lasso, "Don't Let Your Door Swing Wild", www.laundrylasso.com, p. 1.

* cited by examiner

*Primary Examiner* — Jason Y Ko

(74) *Attorney, Agent, or Firm* — The Webb Law Firm

(57) ABSTRACT

A device for a washing machine having a base and an arm is disclosed. The arm is rotatable and pivotable relative to the base. With the base secured to a surface of a washing machine, the arm is pivoted to and locked in a position in which the arm holds the door of the washing machine open.

17 Claims, 18 Drawing Sheets

WASHING MACHINE DEVICE

BACKGROUND OF THE INVENTION

1. Field of the Disclosure

The present disclosure relates generally to a device for a washing machine. More particularly, the present disclosure relates to a device for holding a door of a washing machine open.

2. Description of the Related Art

A washing machine is a machine used to wash laundry, such as clothing and sheets. A problem that may arise with washing machines is the growth of mold and mildew inside the washing machine, and associated surfaces and areas, due to the repeated exposure to water and other wash liquids associated with the cleaning and washing operation of the washing machine. A factor contributing to this problem is a lack of effective air venting within the washing machine when a door of the washing machine is closed. These problems may result in unsanitary conditions, mold, and an unpleasant smell.

SUMMARY OF THE INVENTION

The present disclosure provides a device for a washing machine having a base and an arm. The arm is rotatable and pivotable relative to the base. With the base secured to a surface of a washing machine, the arm is pivoted to and locked in a position in which the arm holds the door of the washing machine open.

In one embodiment, a device of the present disclosure is compatible with any existing washing machines. For example, a device of the present disclosure is easily retrofitted with existing washing machines. In other embodiments, a device of the present disclosure can be manufactured onto a washing machine. In such embodiments, a device of the present disclosure is integral to the washing machine.

In accordance with an embodiment of the present invention, a device for a washing machine includes a base; a housing rotatably connected to the base; and an arm pivotably connected to the housing, the arm extending out from the housing, the arm having a first end and a second end.

In one configuration, the base defines a track, and the housing includes a top end and a bottom end, the bottom end including a post, wherein, with the housing connected to the base, the post is rotatable within the track. In another configuration, the bottom end of the housing includes four posts, wherein, with the housing connected to the base, the four posts are rotatable within the track. In yet another configuration, the housing and the arm are rotatable 360 degrees about the base. In one configuration, the base defines a track, and the housing includes a first housing member and a second housing member, the first housing member connectable to the second housing member, the first housing member including two posts and the second housing member including two posts, wherein, with the first housing member and the second housing member connected to the base, each of the posts are rotatable within the track. In another configuration, the device further includes a lock, the lock transitionable between a first position in which the arm is pivotable about the housing, and a second position in which a position of the arm is fixed. In yet another configuration, the lock includes a wheel having a plurality of teeth, the wheel rotatably received within the first end of the arm; a spring disposed between the arm and the wheel; and an engagement portion disposed on an interior surface of a portion of the housing. In one configuration, with the lock in the first position, the spring is in a compressed position, and the wheel is rotatable relative to the housing and the arm is pivotable about the housing. In another configuration, with the lock in the second position, the spring exerts a force on the wheel towards the engagement portion thereby fixing the engagement portion within the plurality of teeth to lock the wheel relative to the housing and the arm relative to the housing. In yet another configuration, the wheel includes a first side having the plurality of teeth and a second side defining a spring receiving aperture, the spring received within the spring receiving aperture. In one configuration, the lock includes three springs. In another configuration, the engagement portion comprises a plurality of protruding ribs. In yet another configuration, the arm is pivotable greater than 180 degrees relative to the housing. In one configuration, the arm is pivotable greater than 230 degrees relative to the housing. In another configuration, the second end of the arm includes a magnet. In yet another configuration, the base includes a bottom surface having an adhesive. In one configuration, with the base secured to a surface of the washing machine, the arm is pivoted to and locked in a position in which the arm holds a door of the washing machine open.

In accordance with another embodiment of the present invention, a washing machine device includes a washing machine having a door; and an apparatus having a base; a housing rotatably connected to the base; and an arm pivotably connected to the housing, the arm extending out from the housing, the arm having a first end and a second end, wherein, with the base secured to a surface of the washing machine, the arm is pivoted to and locked in a position in which the arm holds the door of the washing machine open.

In one configuration, the device includes a receiving ring attached to an interior surface of the door, wherein, with the base secured to the surface of the washing machine, the second end of the arm contacts a portion of the receiving ring to hold the door of the washing machine open. In another configuration, the second end of the arm includes a magnet.

BRIEF DESCRIPTION OF THE DRAWINGS

The above-mentioned and other features and advantages of this disclosure, and the manner of attaining them, will become more apparent and the disclosure itself will be better understood by reference to the following descriptions of embodiments of the disclosure taken in conjunction with the accompanying drawings, wherein.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1:
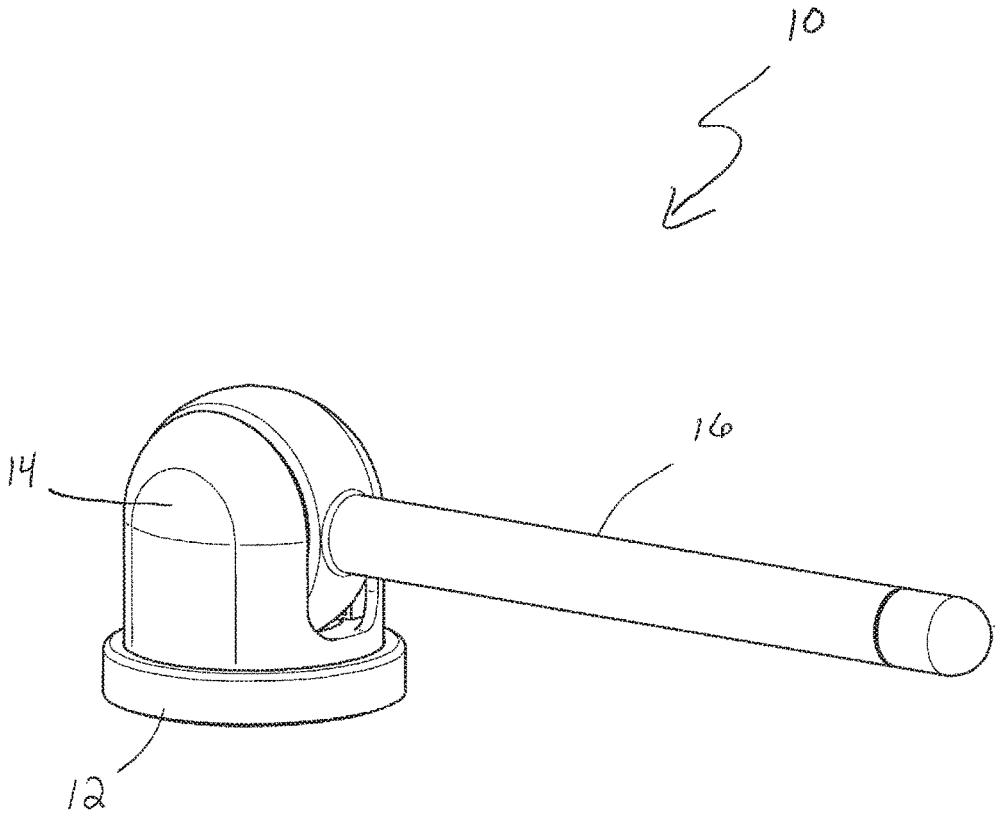
FIG. 1 is a perspective view of a device for a washing machine in a first position in accordance with an embodiment of the present invention.
Figure 2:
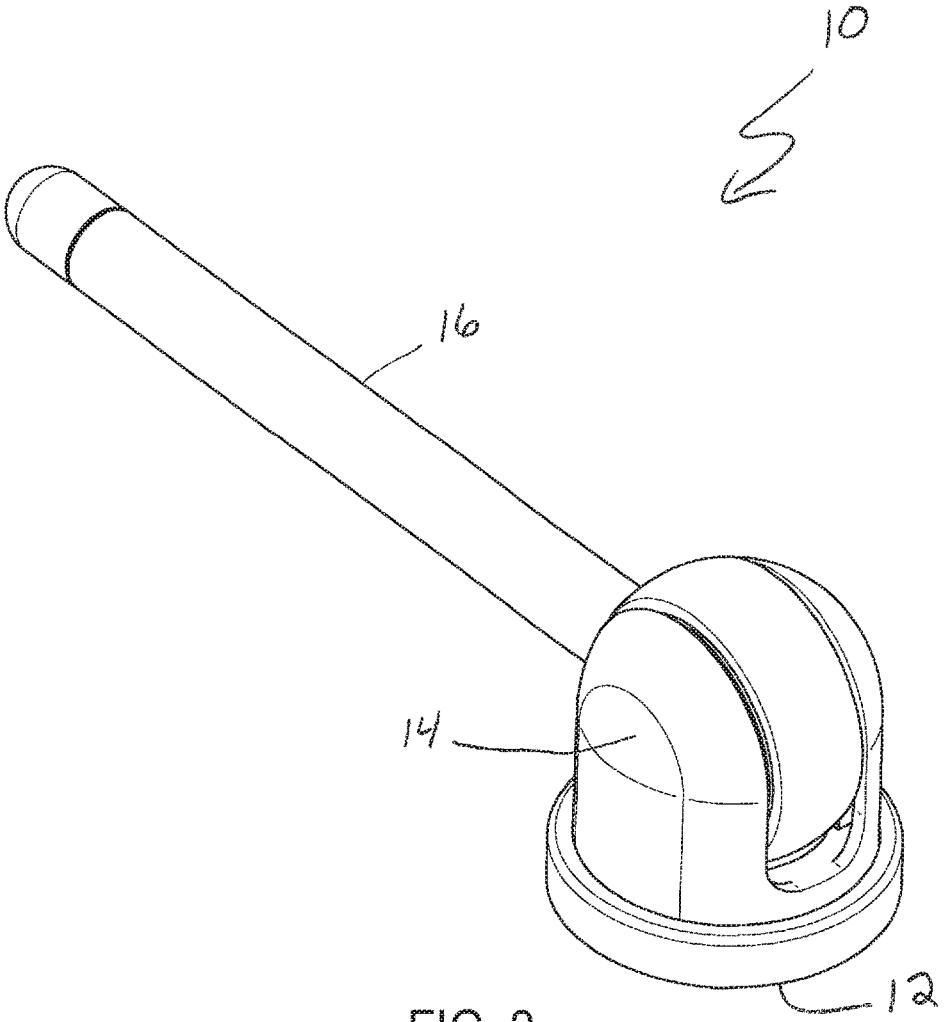
FIG. 2 is a perspective view of a device for a washing machine in a second position in accordance with an embodiment of the present invention.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof, shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present disclosure provides a device for a washing machine having a base and an arm. The arm is rotatable and pivotable relative to the base. With the base secured to a surface of a washing machine, the arm is pivoted to and locked in a position in which the arm holds the door of the washing machine open.

In one embodiment, a device of the present disclosure is compatible with any existing washing machines. For example, a device of the present disclosure is easily retrofitted with existing washing machines. In other embodiments, a device of the present disclosure can be manufactured onto a washing machine. In such embodiments, a device of the present disclosure is integral to the washing machine.

FIGS. 1-14 illustrate an exemplary embodiment of a device for a washing machine of the present disclosure. Referring to FIGS. 1-14, a device 10 for a washing machine 200 of the present disclosure includes a base 12, a housing 14 rotatably connected to the base 12, and an arm 16 pivotably connected to the housing 14. Referring to FIGS. 1-4, the arm 16 extends out from the housing 14.

Figure 11:
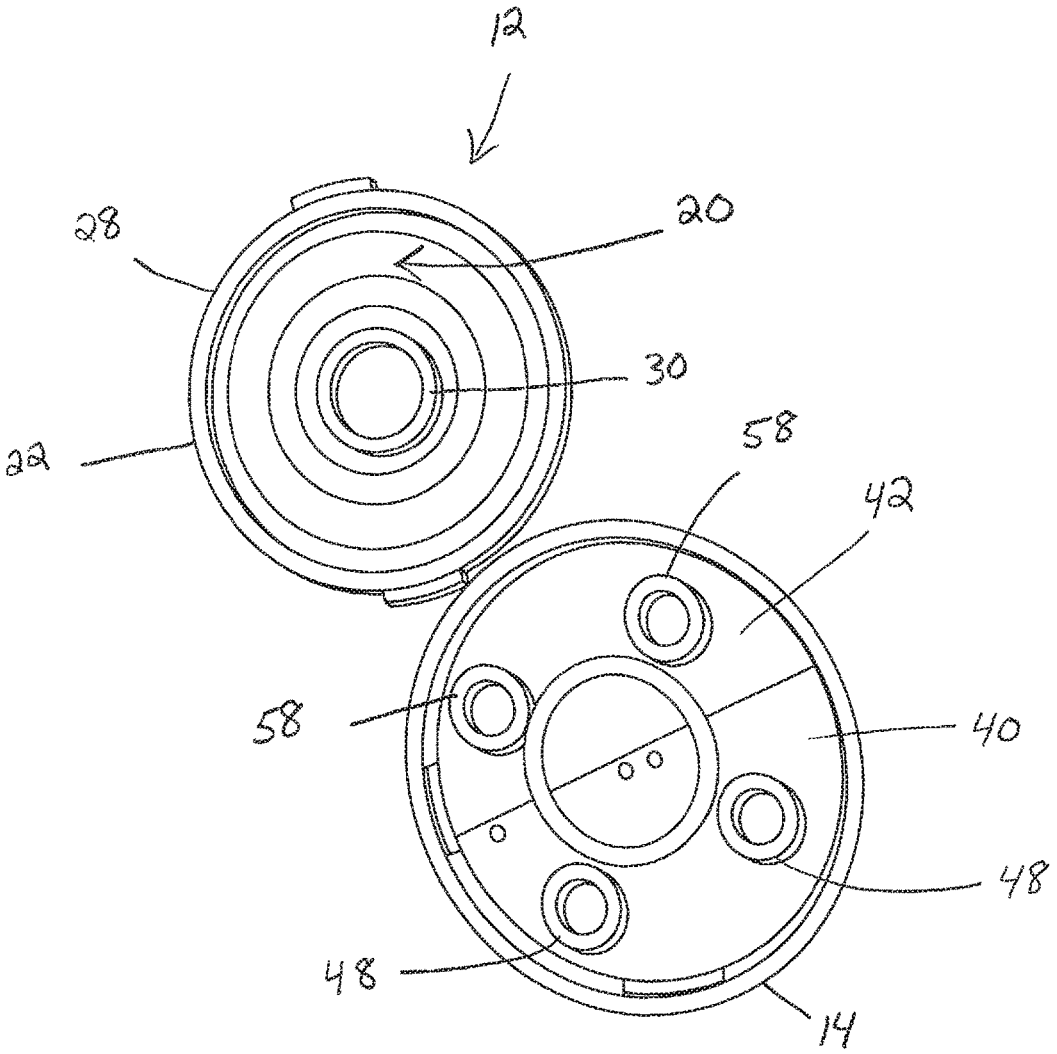
FIG. 11 is a perspective view of a base and a housing of a device for a washing machine in accordance with an embodiment of the present invention.
Figure 12:
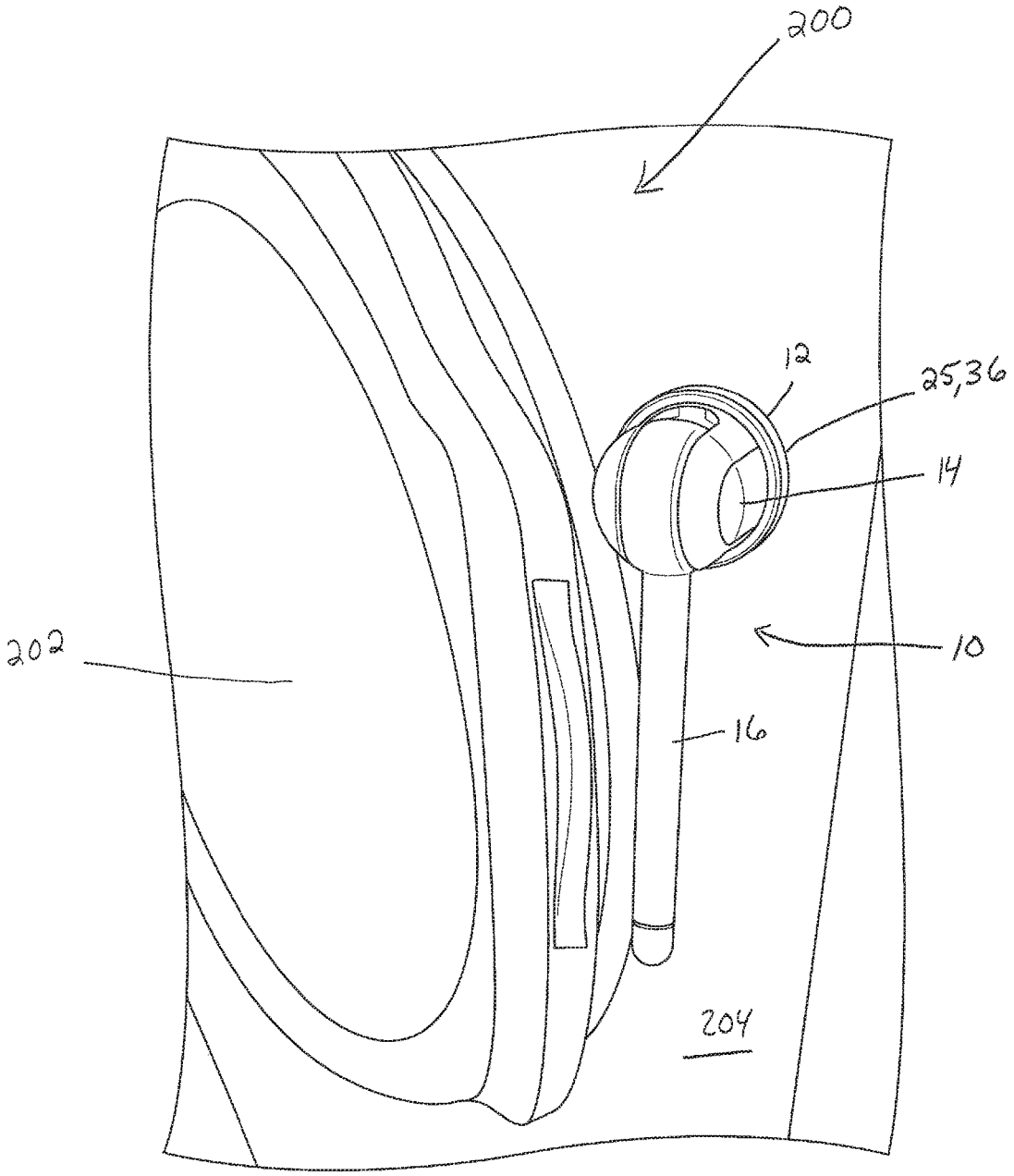
FIG. 12 is a perspective view of a device for a washing machine secured to a surface of a washing machine in a first position in accordance with an embodiment of the present invention.
Figure 13:
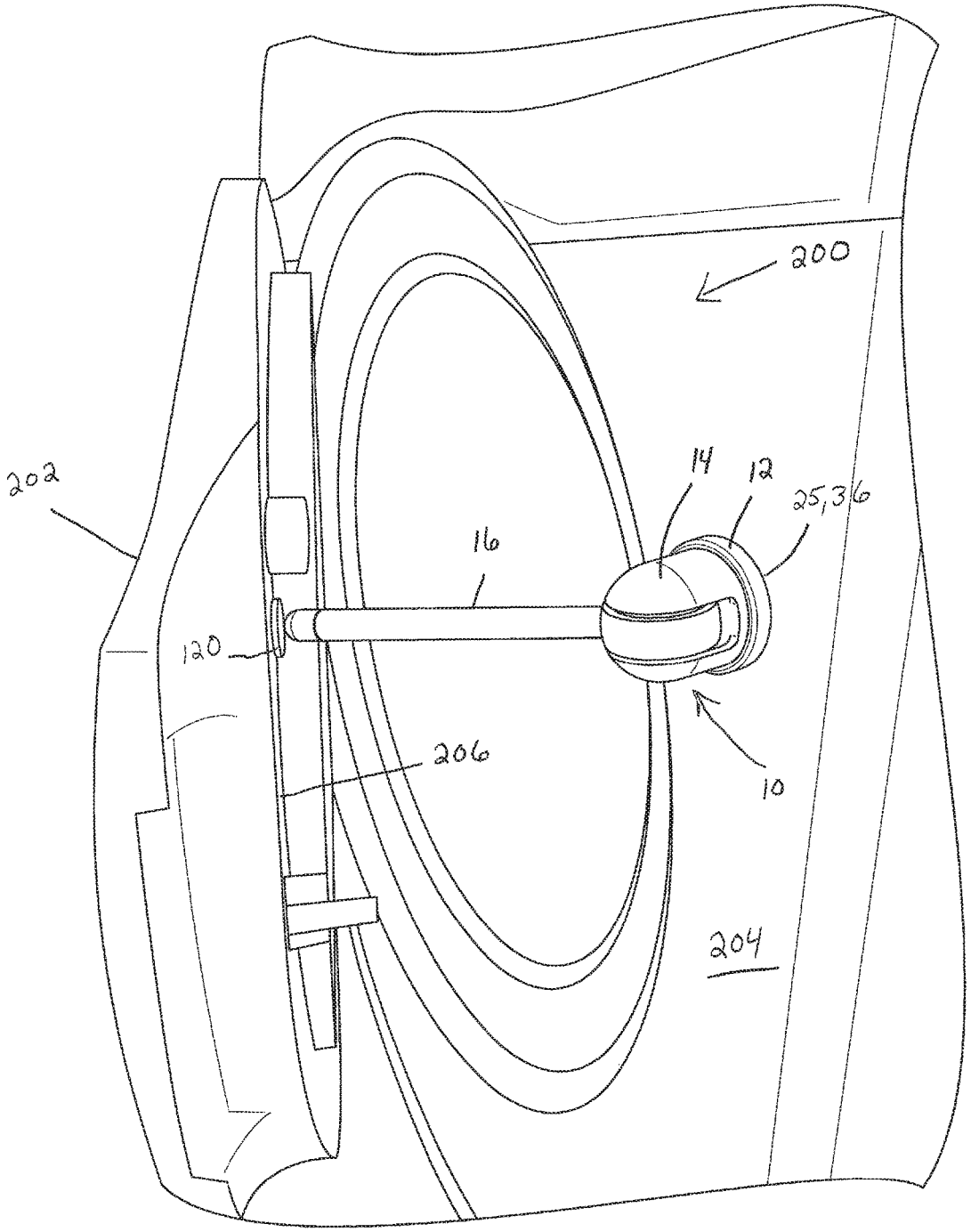
FIG. 13 is a perspective view of a device for a washing machine secured to a surface of a washing machine in a second position with an arm pivoted to and locked in a position in which the arm holds a door of the washing machine open in accordance with an embodiment of the present invention.
Figure 14:
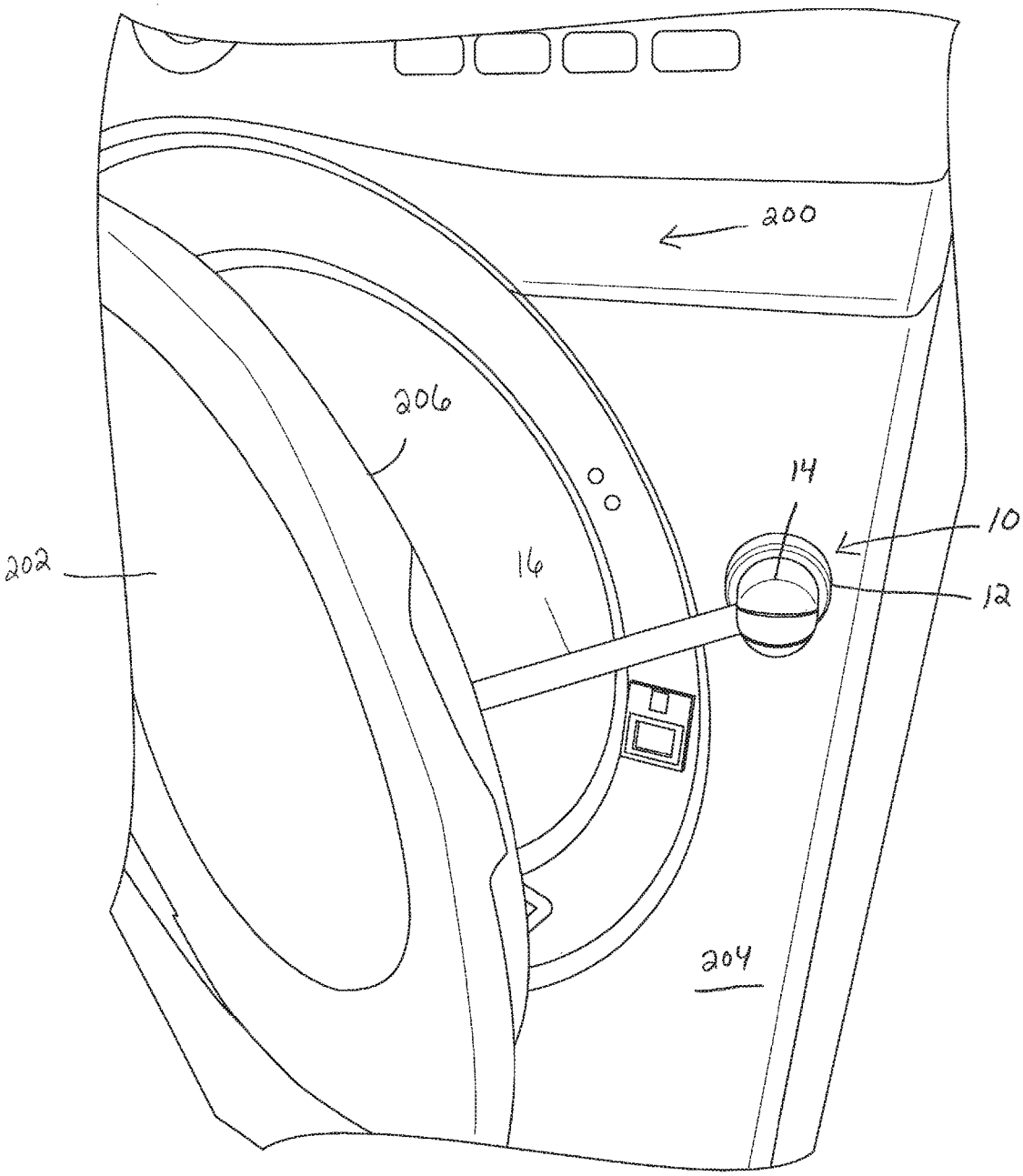
FIG. 14 is a perspective view of a device for a washing machine secured to a surface of a washing machine in a second position with an arm pivoted to and locked in a position in which the arm holds a door of the washing machine open in accordance with an embodiment of the present invention.
Figure 15:
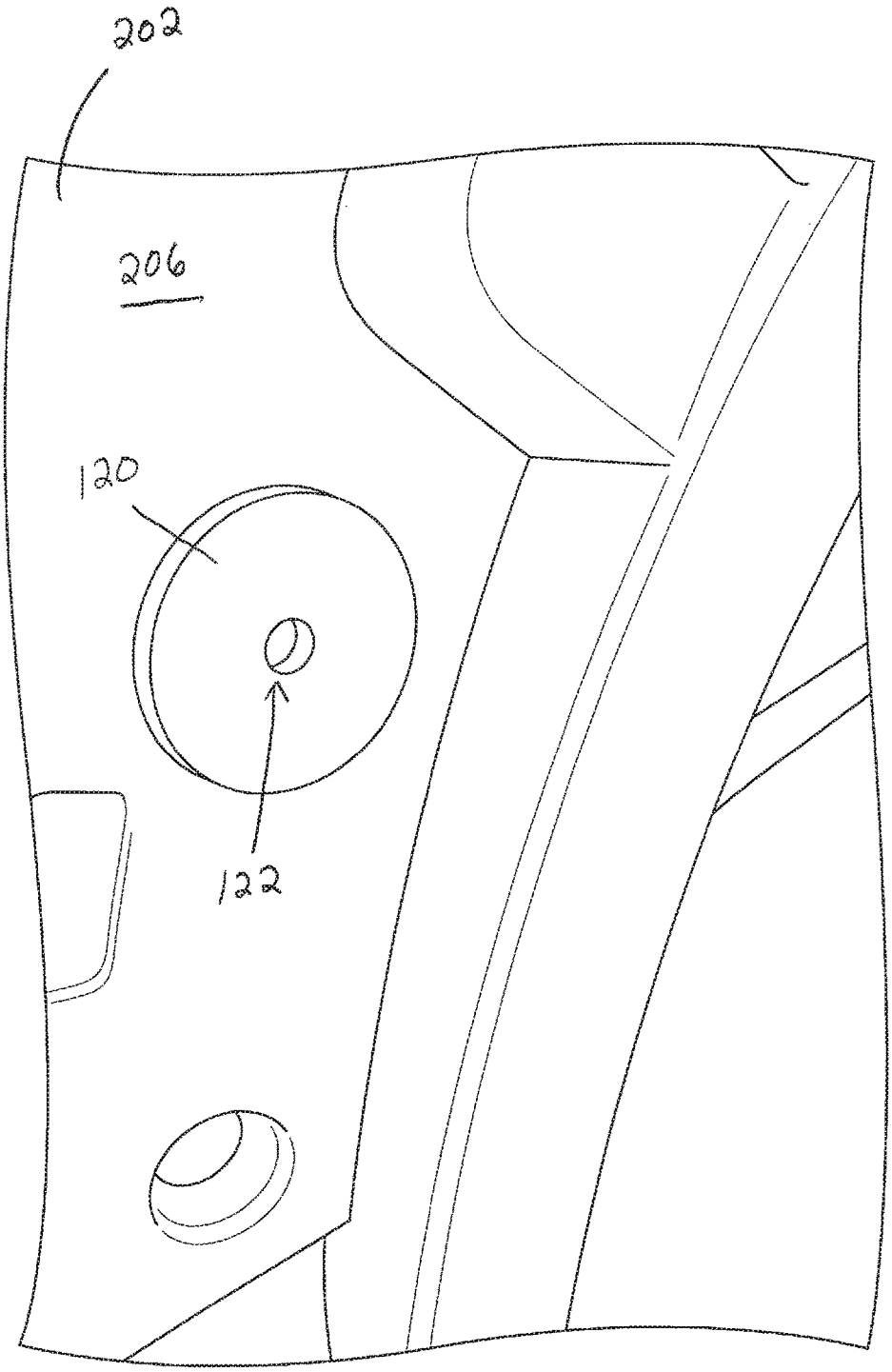
FIG. 15 is a perspective view of a receiving ring attached to an interior surface of a door of a washing machine in accordance with an embodiment of the present invention.
Figure 16:
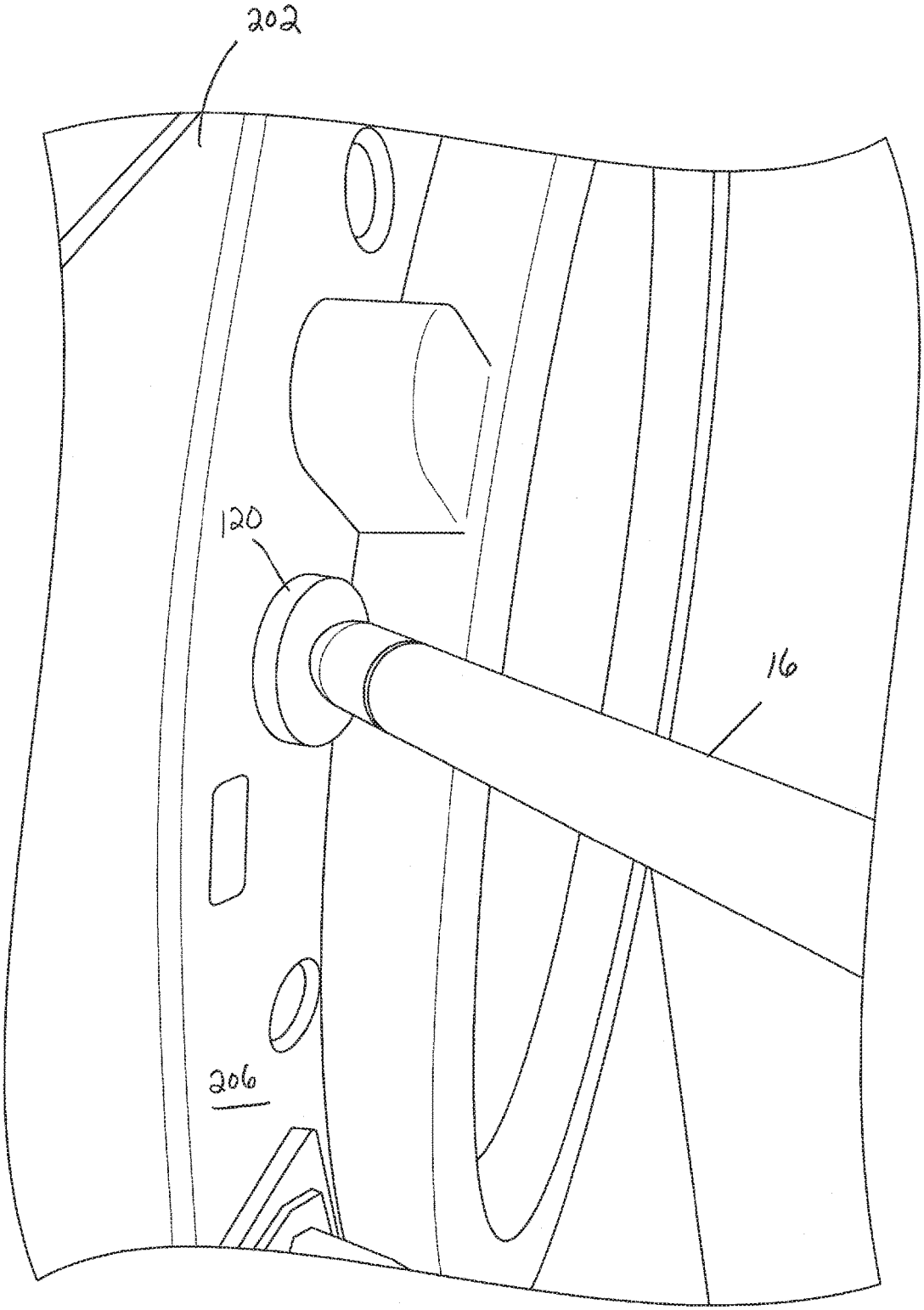
FIG. 16 is a perspective view of a receiving ring attached to an interior surface of a door of a washing machine, with a second end of an arm of a device for a washing machine received within the receiving ring to hold a door of the washing machine open in accordance with an embodiment of the present invention.

Referring to FIGS. 1-8 and 11, the base 12 defines a track 20 and generally includes a top portion 22, a bottom portion 24, and a locking ring 26. Referring to FIGS. 5-8 and 11, in one embodiment, the top portion 22 defines the track 20. Referring to FIG. 11, the top portion 22 includes a peripheral wall 28 and a middle post 30. The track 20 is defined between the peripheral wall 28 and the middle post 30. The bottom portion 24 includes a bottom surface 25. In one embodiment, the bottom surface 25 includes an adhesive 36. In other embodiments, the bottom surface 25 may include other attachment mechanisms for attaching the base 12 of the device 10 to a washing machine 200, as shown in FIGS. 12-14.

In an assembled position, the locking ring 26 is locked to the top portion 22 and the bottom portion 24 to securely connect the base 12 theretogether, as shown in FIGS. 1-4. In one embodiment, the top portion 22 includes a first securement portion 32 and the locking ring 26 includes a second securement portion 34. The first securement portion 32 and the second securement portion 34 engage such that the locking ring 26 locks to the top portion 22 and the bottom portion 24 to securely connect the base 12 theretogether as shown in FIGS. 1-4. The first securement portion 32 and the second securement portion 34 may comprise any mechanical connection mechanism.

Figure 8:
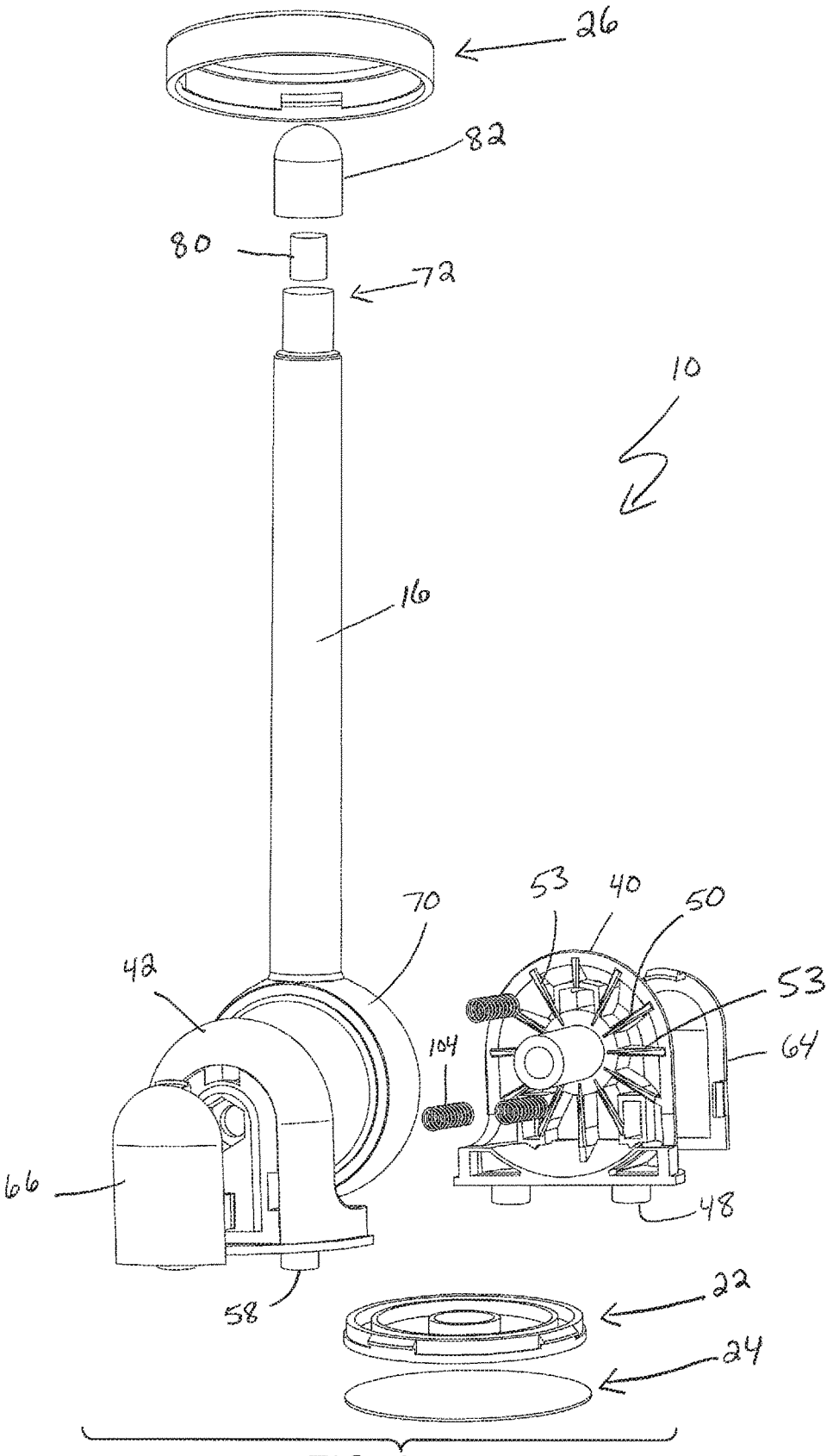
FIG. 8 is an exploded view of a device for a washing machine in accordance with an embodiment of the present invention.

Referring to FIGS. 1-8 and 11, the housing 14 generally includes a first housing member 40 and a second housing member 42. The first housing member 40 includes a top end 44, a bottom end 46, a post 48, an engagement portion 50 disposed on an interior surface 51, and a first connection member 52. In one embodiment, the bottom end 46 of the first housing member 40 includes two posts 48. The second housing member 42 includes a top end 54, a bottom end 56, a post 58, and a second connection member 62. In one embodiment, the bottom end 56 of the second housing member 42 includes two posts 58. In such an embodiment, the bottom end 46, 56 of the housing 14 may include four posts 48, 58, as shown in FIGS. 5-8 and 11. In one embodiment, the engagement portion 50 includes a plurality of protruding ribs 53 (FIG. 8).

Referring to FIGS. 1-8 and 11, with the housing 14 connected to the base 12, the posts 48, 58 of the housing 14 are rotatable within the track 20 of the base 12 so that the housing 14 is rotatably connected to the base 12. In this manner, the housing 14 is rotatable 360 degrees about the base 12.

In one embodiment, the first housing member 40 and the second housing member 42 are connectable via engagement of the first connection member 52 and the second connection member 62. For example, the first connection member 52 and the second connection member 62 may comprise any mechanical connection mechanism. In one embodiment, a pin 90 is rotatably connected to a portion of the first housing member 40 at a first end 94 and a portion of the second housing member 42 at an opposite second end 96, as discussed below. The pin 90 allows for an arm 16 and a wheel 102 to be pivotably and rotatably connected to the housing 14.

Referring to FIGS. 5-8, the housing 14 may also include a first outer housing portion 64 connectable to the first housing member 40 and a second outer housing portion 66 connectable to the second housing member 42. In some embodiments, the first outer housing portion 64 and the first housing member 40 may form a single housing component and the second outer housing portion 66 and the second housing member 42 may form a single housing component.

Referring to FIGS. 1-10B, the arm 16 generally includes a first end 70 and a second end 72. In one embodiment, the first end 70 forms a circular base portion pivotably and rotatably received within the housing 14. The first end 70 of the arm 16 includes a receiving cavity 74 and a post 76 defining a channel 78. The receiving cavity 74 rotatably receives a wheel 102 of a lock 100, as described in more detail below. The second end 72 of the arm 16 includes a magnet 80 and a cap 82 for securely locking the magnet 80 within the second end 72 of the arm 16.

Advantageously, the device 10 of the present disclosure includes a lock 100 that allows for pivoting of the arm 16 into a desired position and once a desired position is reached, the arm 16 is able to be locked into that position. For example, the lock 100 of the present disclosure generally includes a wheel 102, a spring 104, and the engagement portion 50 disposed on an interior surface 51 of the first housing member 40 of the housing 14.

Figure 9:
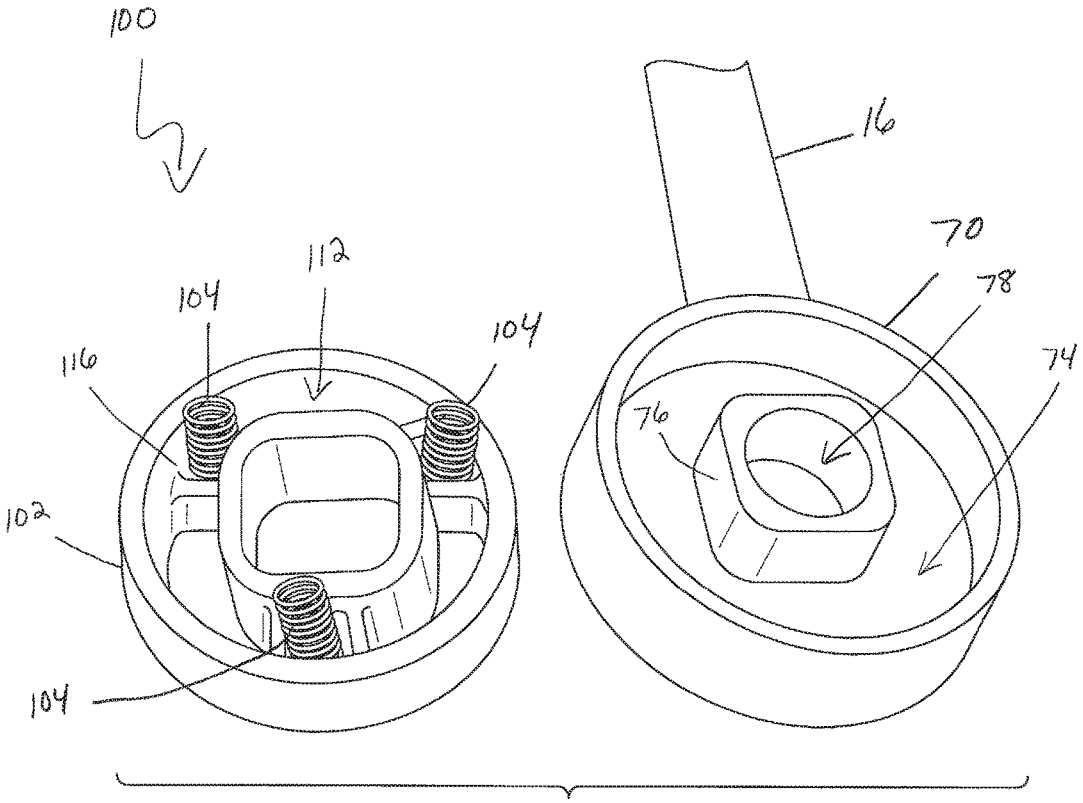
FIG. 9 is a perspective view of a wheel and an arm of a device for a washing machine in accordance with an embodiment of the present invention.

The wheel 102 includes a first side 110 and a second side 112. The first side 110 includes a plurality of teeth 114 and the second side 112 defines a spring receiving aperture 116 (FIG. 9). In one embodiment, the second side 112 of the wheel 102 defines three spring receiving apertures 116, as shown in FIG. 9.

In one embodiment, the spring 104 is disposed between the first end 70 of the arm 16 and the wheel 102. For example, referring to FIG. 9, the spring 104 is received within the spring receiving aperture 116 of the wheel 102. In one embodiment, the lock 100 of the device 10 of the present disclosure includes three springs 104.

The lock 100 of the present disclosure is transitionable between a first position in which the arm 16 is pivotable about the housing 14, and a second position in which a position of the arm 16 is fixed or locked.

Referring to FIGS. 1-8 and 10A, with the lock 100 in the first or unlocked position, the spring 104 is in a compressed position, and the wheel 102 is rotatable relative to the housing 14 and the arm 16 is pivotable about the housing 14.

Referring to FIGS. 1-8 and 10B, with the lock 100 in the second or locked position, the spring 104 exerts a force on the wheel 102 towards the engagement portion 50 of the housing 14, thereby fixing the protruding ribs 53 of the engagement portion 50 within the plurality of teeth 114 of the wheel 102 to lock the wheel 102 relative to the housing 14 and the arm 16 relative to the housing 14.

For example, in use, a position of the arm 16 is fixed or locked by the lock 100. In the locked position, referring to FIG. 10B, the springs 104 exert a force on the wheel 102 toward the protruding ribs 53 of the first housing member 40. This force exerted by the springs 104 pushes the protruding ribs 53 into engagement with the plurality of teeth 114 of the wheel 102, thereby locking the wheel 102 relative to the housing 14 and the arm 16 relative to the housing 14. In this manner, a position of the arm 16 is locked or fixed relative to the housing 14. In the locked position, the protruding ribs 53 of the housing 14 lock within the plurality of teeth 114 of the wheel 102, i.e., each rib 53 is positioned within a space between adjacent teeth 114.

Figure 10A:
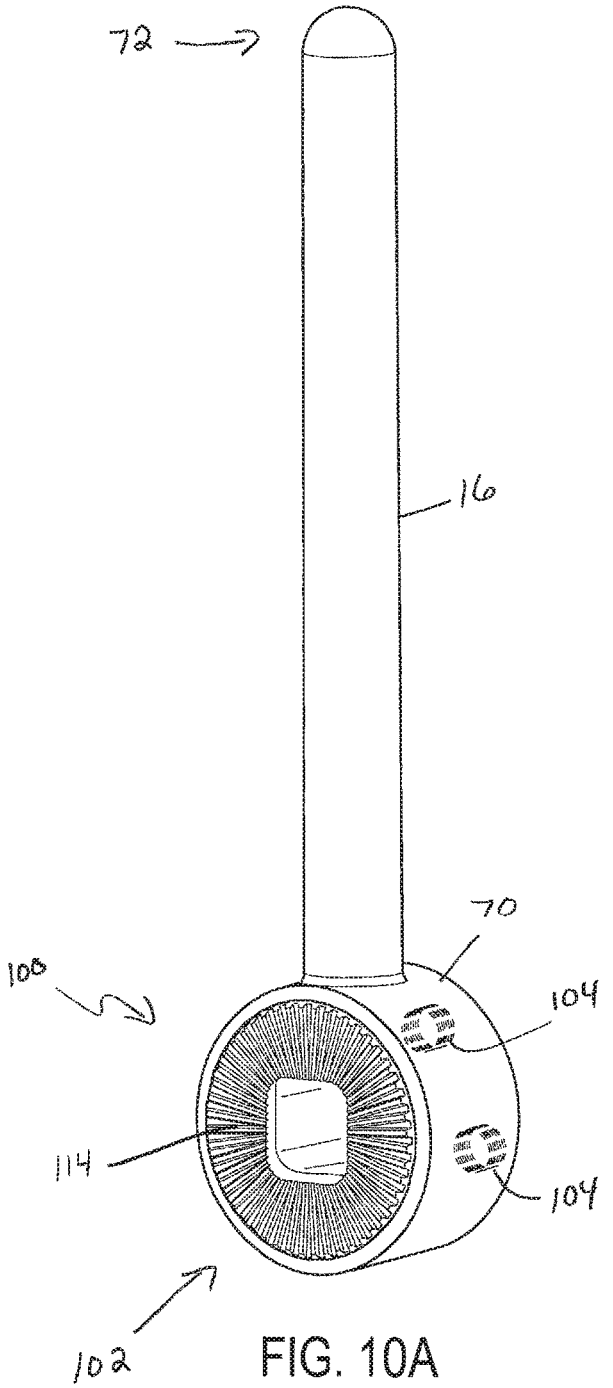
FIG. 10A is a perspective view of a portion of a lock of a device for a washing machine in a first position in accordance with an embodiment of the present invention.
Figure 10B:
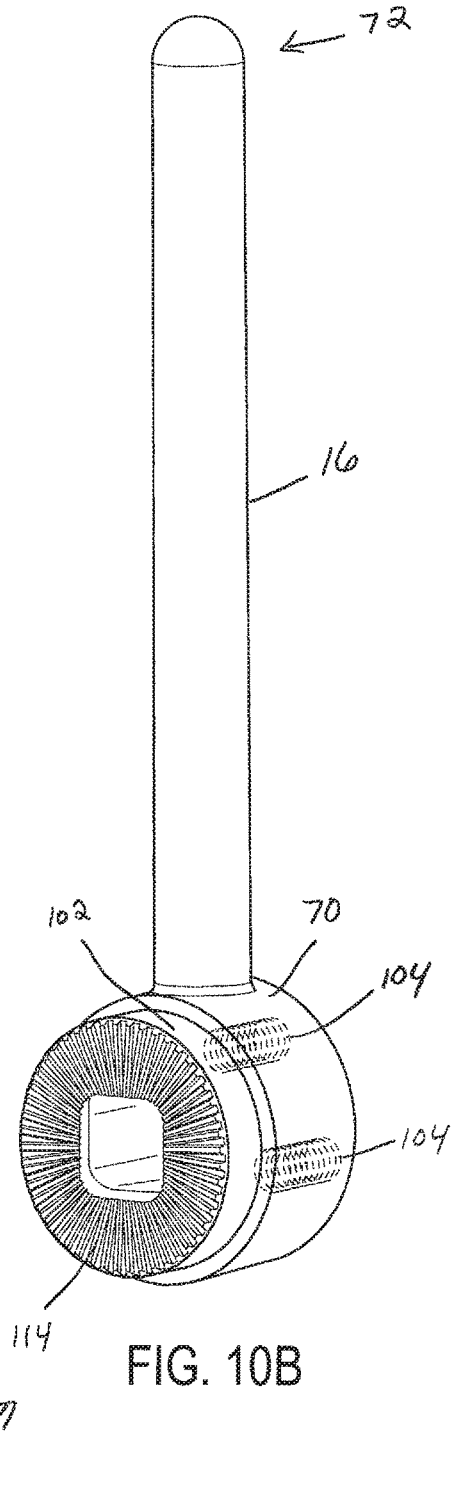
FIG. 10B is a perspective view of a portion of a lock of a device for a washing machine in a second position in accordance with an embodiment of the present invention.

When it is desired to change a position of the arm 16, a user grasps a portion of the arm 16 and exerts a force on the arm 16 in a direction the user desires the arm 16 to move to. This force exerted by a user on the arm 16 causes the ribs 53 to contact an outer portion of the teeth 114 thereby compressing the springs 104 as shown in FIG. 10A. With the springs 104 in a compressed position, the lock 100 is in an unlocked position, and the arm 16 is able to be moved into a new position by a user. With the lock 100 is in an unlocked position, the wheel 102 is rotatable relative to the housing 14 and the arm 16 is pivotable about the housing 14.

The device 10 and the lock 100 of the present disclosure are designed such that minor forces exerted on the arm 16, such as if accidental contact with the arm 16 occurs, do not move the lock 100 into the unlocked position. The lock 100 is maintained in the locked position, such that a position of the arm 16 is locked or fixed relative to the housing 14, until a significant force is exerted on the arm 16 when a user wishes to move the arm 16 into a new position.

Referring to FIGS. 5-8, the arm 16 and the wheel 102 are pivotably and rotatably received within the housing 14. In one embodiment, the arm 16 and the wheel 102 are connected to the housing 14 via a pin 90. For example, a pin 90 is received within the channel 78 of the first end 70 of the arm 16. In this manner, the arm 16 and the wheel 102 are able to pivot and rotate on the pin 90. The pin 90 is rotatably connected to a portion of the first housing member 40 at a first end 94 and a portion of the second housing member 42 at an opposite second end 96. The pin 90 may be connected at one end of the housing 14 using a fastener 92.

Figure 3:
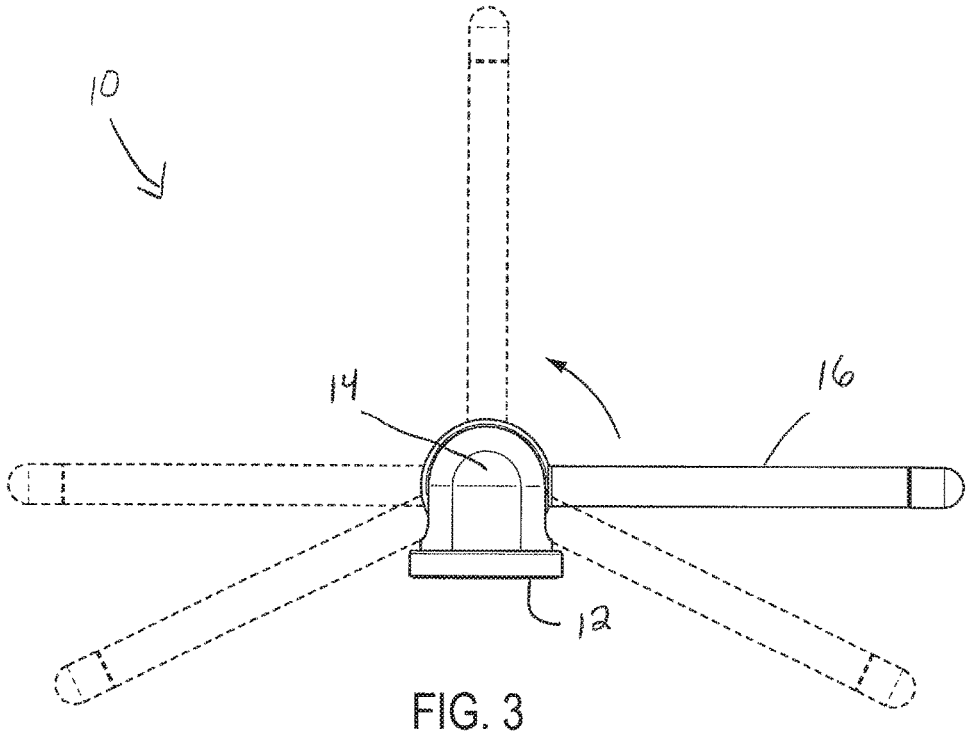
FIG. 3 is a side elevation view of a device for a washing machine in accordance with an embodiment of the present invention.
Figure 4:
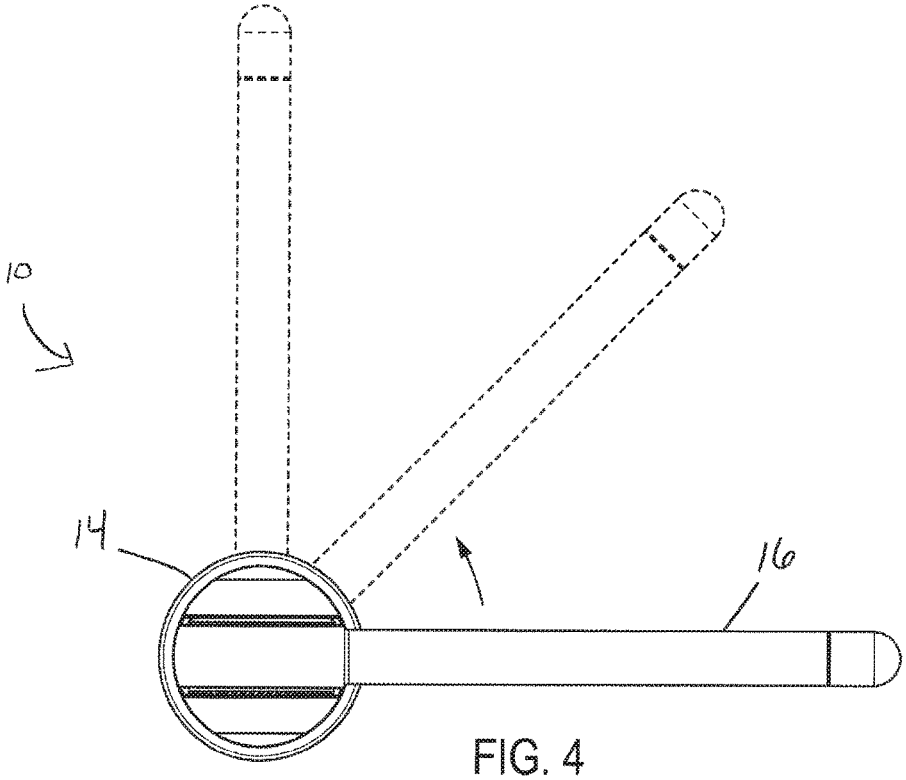
FIG. 4 is a top elevation view of a device for a washing machine in accordance with an embodiment of the present invention.
Figure 5:
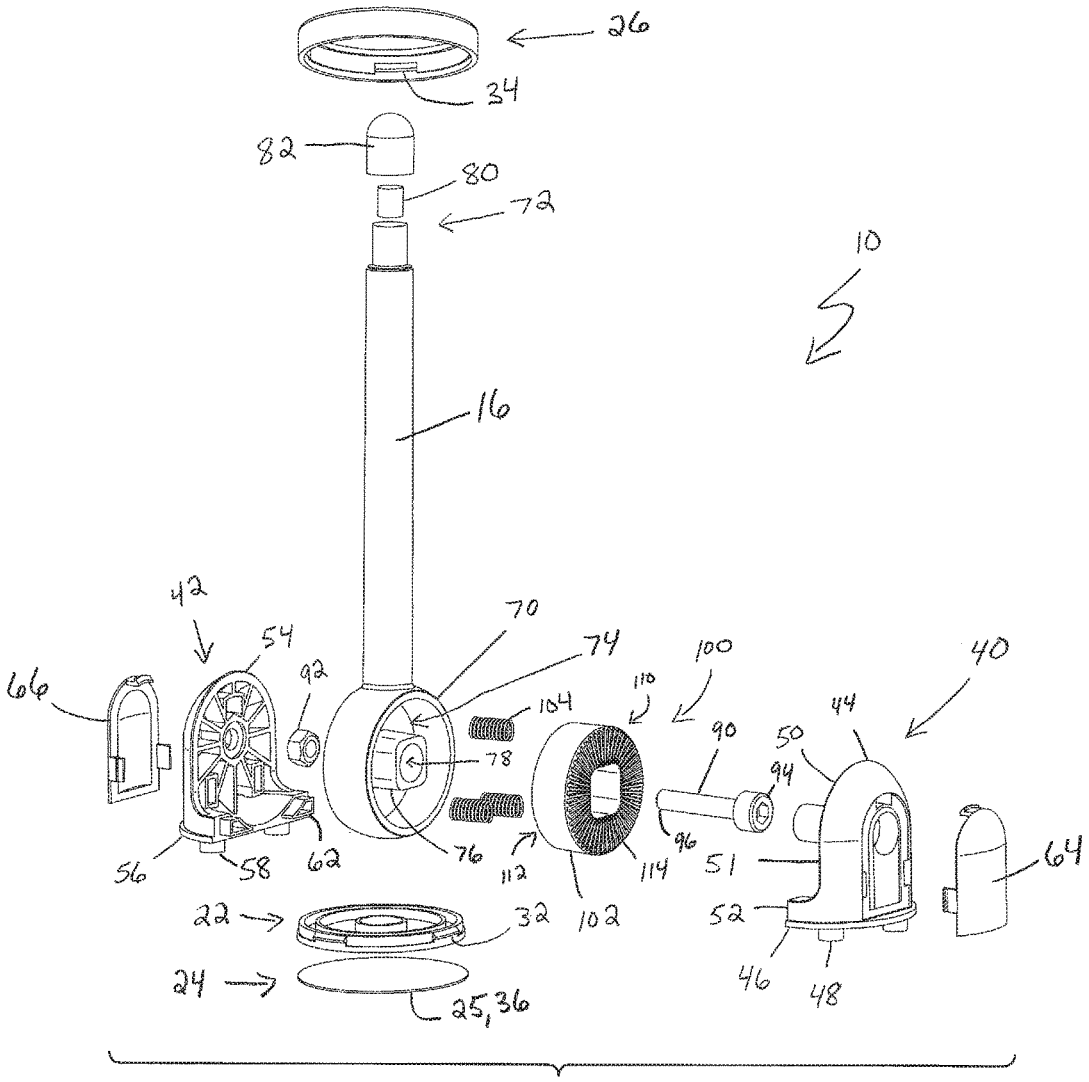
FIG. 5 is an exploded view of a device for a washing machine in accordance with an embodiment of the present invention.
Figure 6:
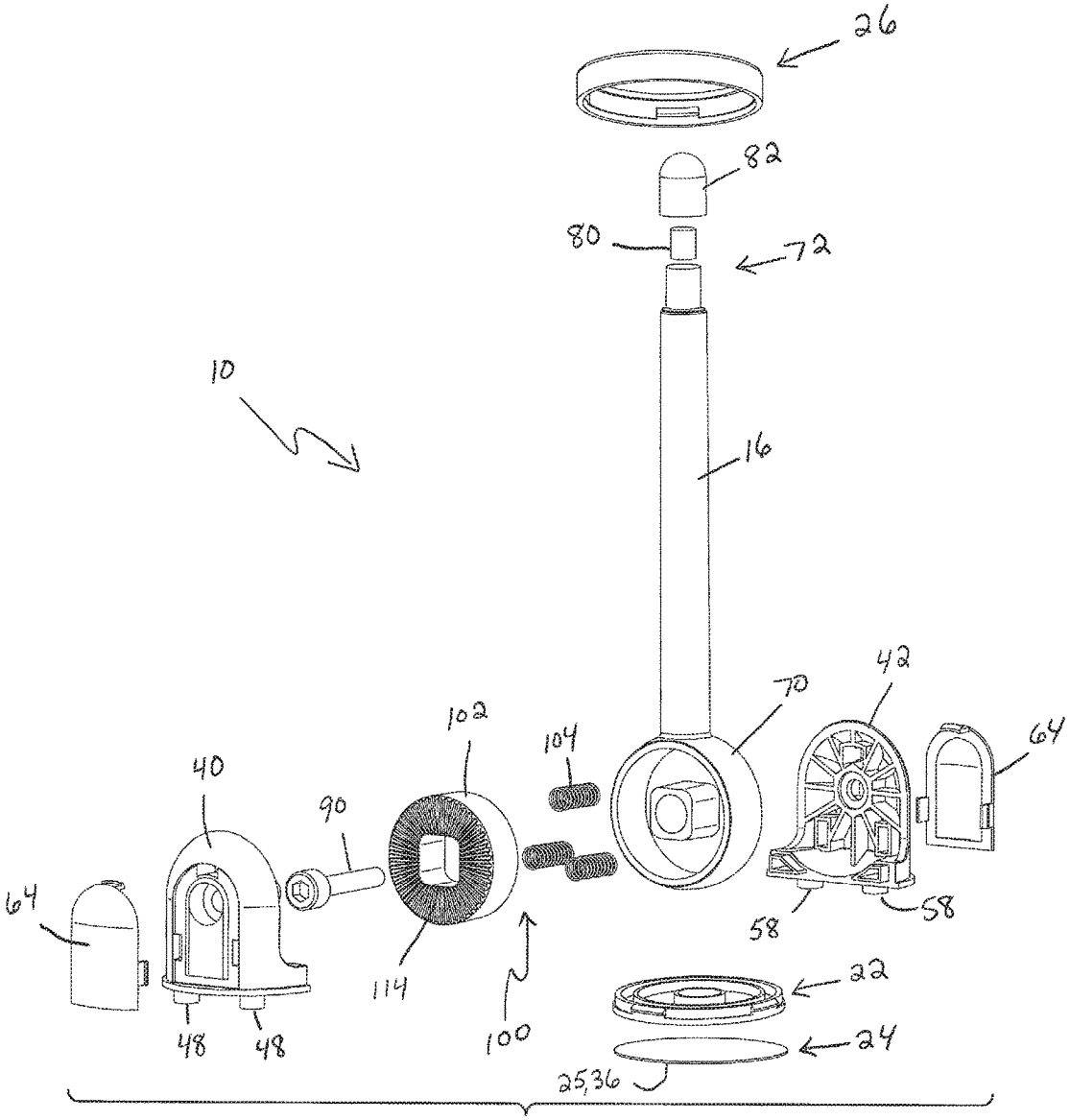
FIG. 6 is an exploded view of a device for a washing machine in accordance with an embodiment of the present invention.
Figure 7:
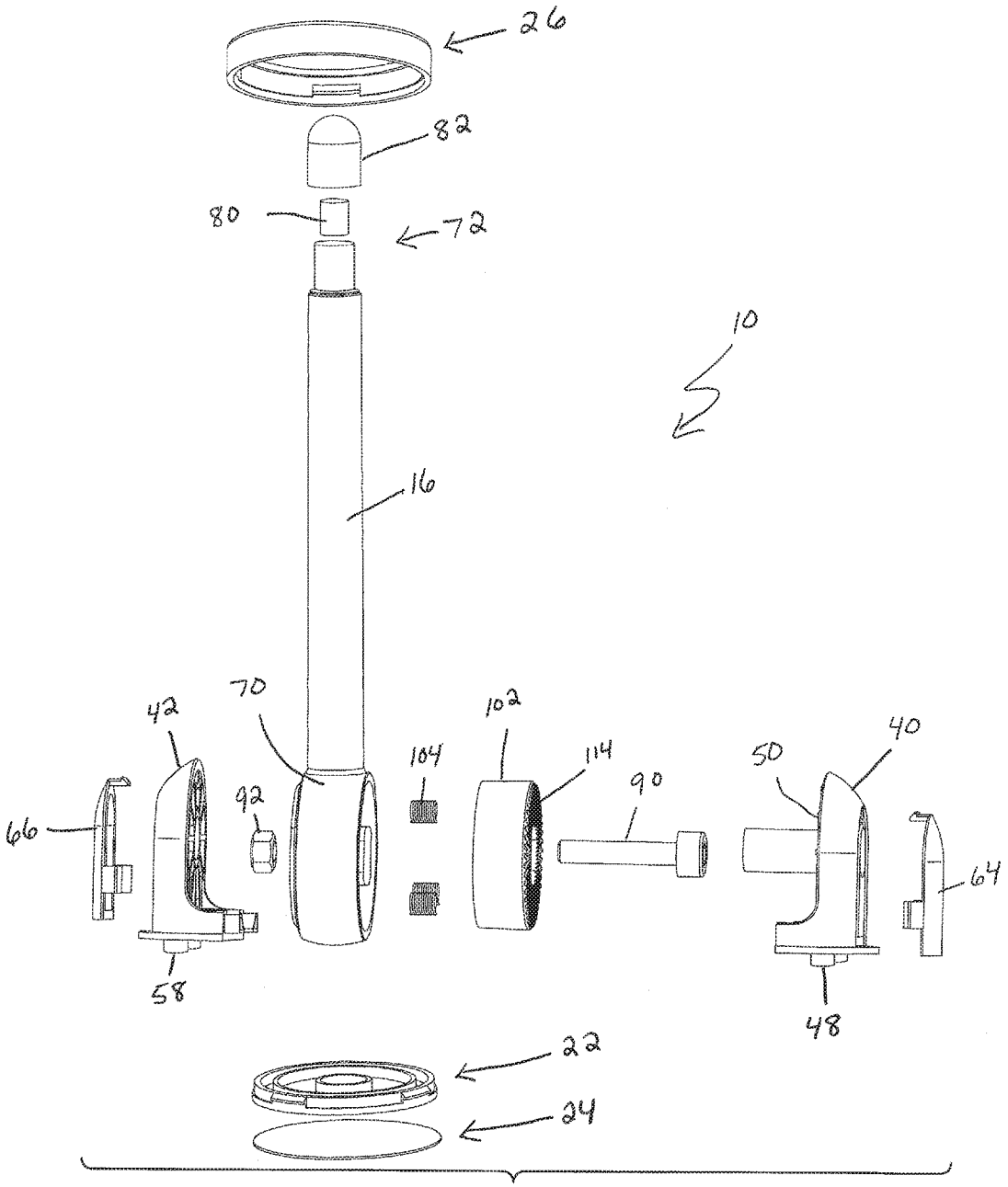
FIG. 7 is an exploded view of a device for a washing machine in accordance with an embodiment of the present invention.

Advantageously, the rotatable and pivotable connections of the arm 16 to the housing 14 described above, allows the arm to be rotatable 360 degrees about the base 12, as shown in FIG. 4, and the arm to be pivotable greater than 180 degrees relative to the housing 14, as shown in FIG. 3. In one embodiment, the arm 16 is pivotable greater than 230 degrees relative to the housing 14, as shown in FIG. 3. In one embodiment, the arm 16 is pivotable approximately 235 degrees relative to the housing 14 as shown in FIG. 3. In this manner, the device 10 of the present disclosure allows the arm 16 to be moved into any desired position as described in more detail below.

Referring to FIGS. 12-14, use of the device 10 of the present disclosure to hold a door of a washing machine open will now be described.

Referring to FIGS. 12-14, the device 10 of the present disclosure is used with a washing machine 200 having a door 202 and a surface 204. The base 12 of the device 10 is secured to the surface 204 of the washing machine 200, as shown in FIGS. 12-14. In one embodiment, base 12 includes a bottom surface 25 having an adhesive 36. In this manner, the base 12 of the device 10 can be easily secured to a desired surface 204 of a washing machine 200, as shown in FIGS. 12-14.

When a washing machine 200 is in use and the door 202 is closed, the device 10 can be moved into a position as shown in FIG. 12. In such a position, the device 10 does not interfere with the opening and closing of the door 202 and the washing machine 200 is able to be used in a normal manner.

After the washing machine 200 is done being used, the arm 16 of the device is able to be rotated and pivoted into a position shown in FIG. 13. Once the arm 16 is moved into a desired position, the lock 100 of the present disclosure locks the arm 16 relative to the housing 14 as described above. In such a position, the arm 16 of the device 10 of the present disclosure is able to hold the door 202 of the washing machine 200 in an open position. With the door 202 maintained in this open position using the device 10 of the present disclosure, the washing machine 200 is able to be properly aired out, thereby preventing any unsanitary conditions, mold, and/or any unpleasant smells.

In one embodiment, the arm 16 has a length of approximately five (5) to six (6) inches. In other embodiments, the length of the arm 16 could vary depending on various washing machine applications. In one embodiment, the device 10 of the present disclosure holds a door 202 of a washing machine 200 open approximately six (6) to nine (9) inches. In other embodiments, the device (10) of the present disclosure may hold a door 202 of a washing machine 200 open other amounts depending on various washing machine applications. In one embodiment, the device 10 of the present disclosure holds a door 202 of a washing machine 200 open at an angle of approximately 25 degrees to 45 degrees. In other embodiments, the device 10 of the present disclosure holds a door 202 of a washing machine 200 open at other angles depending on various washing machine applications.

These dimensions and distances can be altered depending on the placement of the device 10 on a washing machine 200 and an attachment point between the arm 16 of the device 10 and a door 202 of a washing machine 200. Additionally, these dimensions and distances can be altered by pivoting and rotating the arm 16 of the device 10 into a desired orientation.

As discussed above, the arm 16 is able to be rotated and pivoted into any desired position. This allows the position of the arm 16 to be controlled and the distance that the door 202 of the washing machine 200 is opened can be easily controlled.

Referring to FIGS. 13-18, in one embodiment, the device 10 of the present disclosure includes a receiving ring 120 defining a central aperture 120. The receiving ring 120 is attached to an interior surface 206 of the door 202 of the washing machine 200, as shown in FIGS. 13-18.

With the receiving ring 120 attached to an interior surface 206 of the door 202 and, with the base 12 secured to a surface 204 of the washing machine 200, the second end 72 of the arm 16 contacts a portion of the receiving ring 120 to hold the door 202 of the washing machine 200 open.

In one embodiment, the receiving ring 120 may be formed of a magnet. The second end 72 of the arm 16 includes the magnet 80 that can be magnetically attracted and connected to the receiving ring 120 to secure the second end 72 of the arm 16 to the receiving ring 120.

Figure 18:
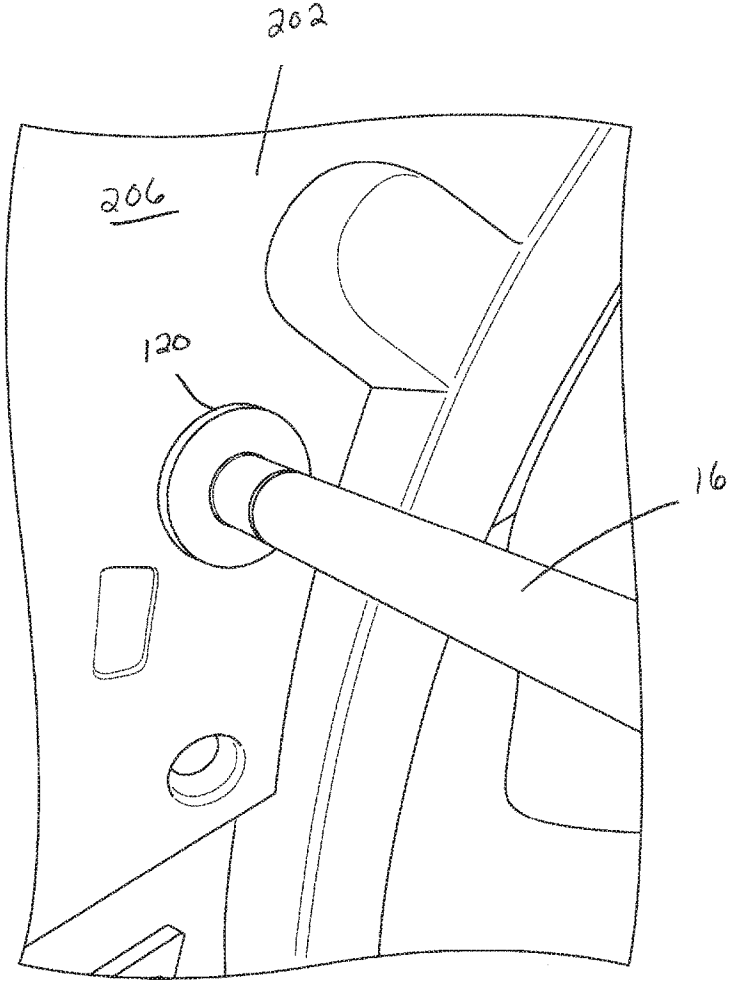
FIG. 18 is a perspective view of a receiving ring attached to an interior surface of a door of a washing machine, with a second end of an arm of a device for a washing machine received within the receiving ring to hold a door of the washing machine open in accordance with another embodiment of the present invention.
Figure 17:
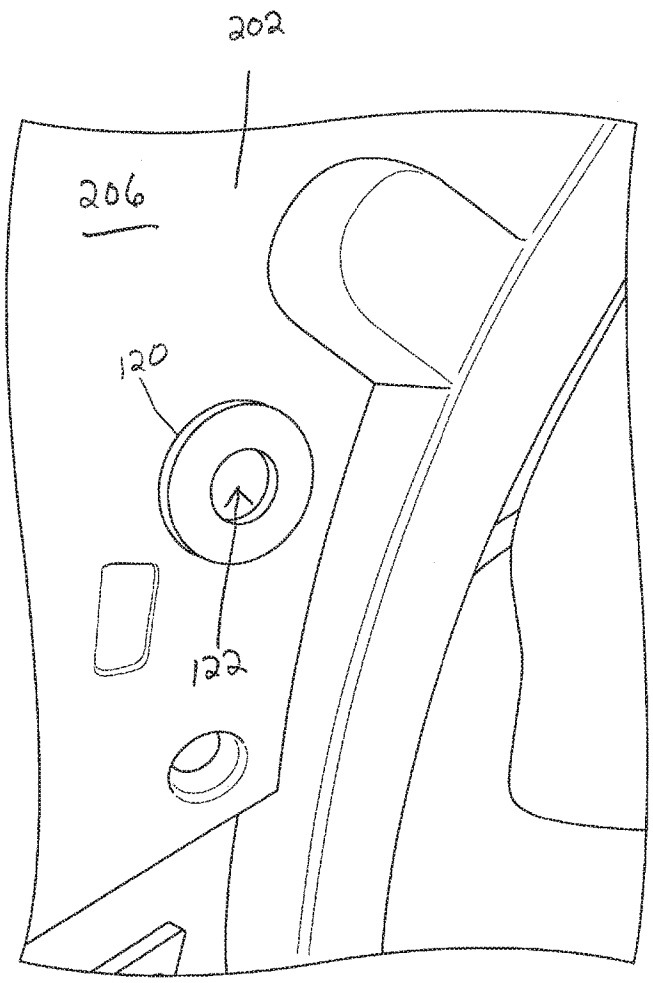
FIG. 17 is a perspective view of a receiving ring attached to an interior surface of a door of a washing machine in accordance with another embodiment of the present invention.

In one embodiment, the central aperture 122 of the receiving ring 120 is sized to receive the second end 72 of the arm 16 therein, as shown in FIGS. 17 and 18.

Figure 19A:
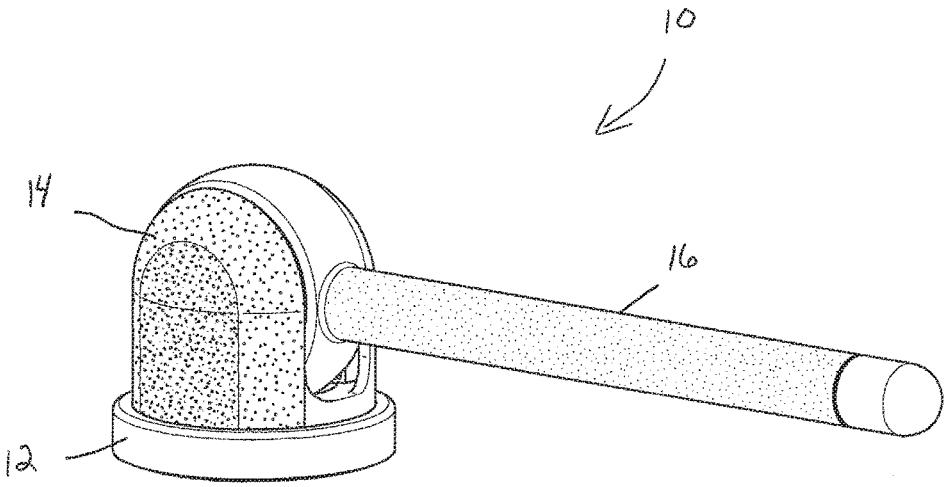
FIG. 19A is a perspective view of a device for a washing machine in accordance with another embodiment of the present invention.
Figure 19B:
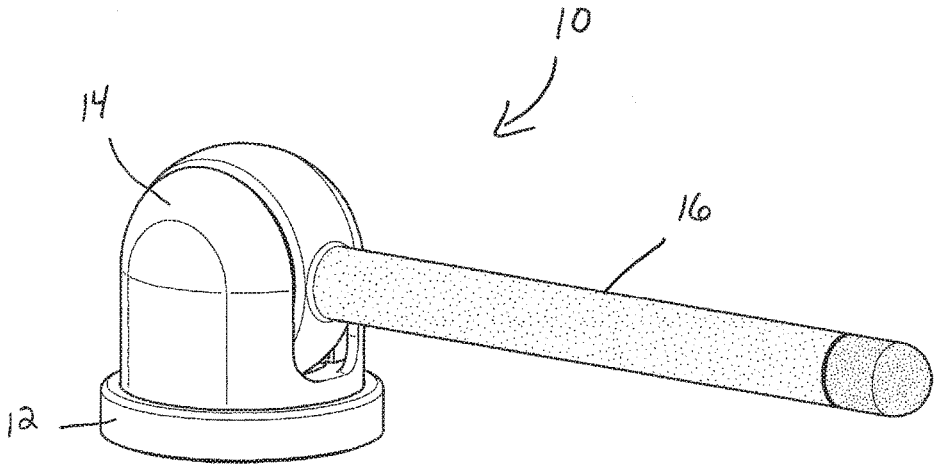
FIG. 19B is a perspective view of a device for a washing machine in accordance with another embodiment of the present invention.

Referring to FIGS. 19A and 19B, alternative embodiments of a device 10 of the present disclosure are shown. For example, the materials and surface finishes of the base 12, the housing 14, and the arm 16 may be different. For example, the arm 16 may be formed of a first material and the housing 14 may be formed of a different second material.

In one embodiment, the base 12, the housing 14, and the arm 16 are formed of plastic materials. In other embodiments, the base 12, the housing 14, and the arm 16 could be formed of other materials, such as steel, metal, wood, or other materials, depending on various washing machine applications.

Figure 20:
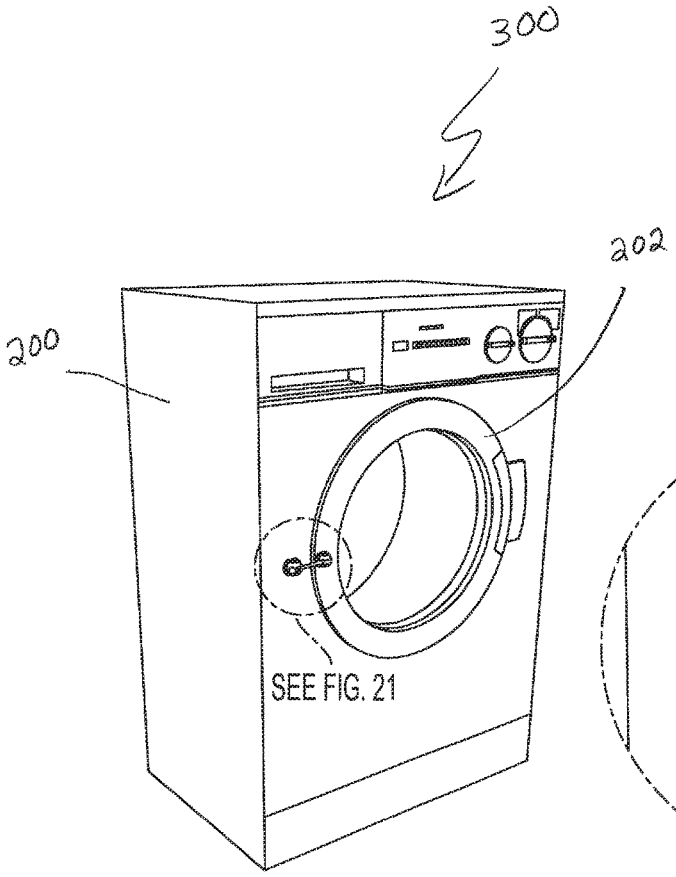
FIG. 20 is a perspective view of a device for a washing machine in accordance with another embodiment of the present invention.
Figure 21:
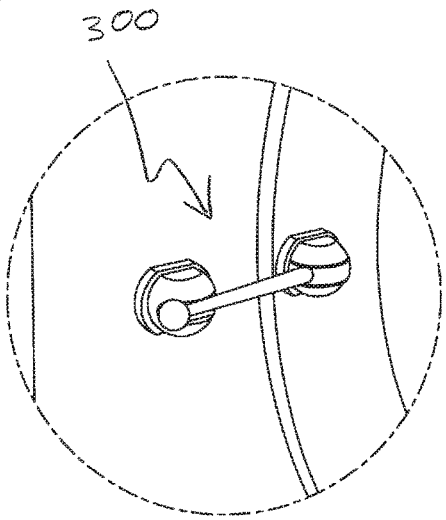
FIG. 21 is a perspective view of a device for a washing machine in accordance with another embodiment of the present invention.

Referring to FIGS. 20 and 21, an alternative embodiment device 300 of the present disclosure is shown. The device 300 of the present disclosure is able to be used to hold a door of a washing machine open.

In one embodiment, a device of the present disclosure is compatible with any existing washing machines. For example, a device of the present disclosure is easily retrofitted with existing washing machines. In other embodiments, a device of the present disclosure can be manufactured onto a washing machine. In such embodiments, a device of the present disclosure is integral to the washing machine.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A washing machine device, comprising:

a washing machine having a door; and an apparatus integral with the washing machine, the apparatus comprising:

a base;

a housing rotatably connected to the base; and an arm pivotably connected to the housing, the arm extending out from the housing, the arm having a first end and a second end, wherein, with the base secured to a surface of the washing machine, the arm is pivoted to and locked in a position in which the arm holds the door of the washing machine open.

2. The washing machine device of claim 1, wherein the base defines a track, and the housing includes a top end and a bottom end, the bottom end including a post, wherein, with the housing connected to the base, the post is rotatable within the track.

3. The washing machine device of claim 2, wherein the bottom end of the housing includes four posts, wherein, with the housing connected to the base, the four posts are rotatable within the track.

4. The washing machine device of claim 1, wherein the housing and the arm are rotatable 360 degrees about the base.

5. The washing machine device of claim 1, wherein the base defines a track, and the housing includes a first housing member and a second housing member, the first housing member connectable to the second housing member, the first housing member including two posts and the second housing member including two posts, wherein, with the first housing member and the second housing member connected to the base, each of the posts are rotatable within the track.

6. The washing machine device of claim 1, further comprising a lock, the lock transitionable between a first position in which the arm is pivotable about the housing, and a second position in which a position of the arm is fixed.

7. The washing machine device of claim 6, wherein the lock comprises:

a wheel having a plurality of teeth, the wheel rotatably received within the first end of the arm;

a spring disposed between the arm and the wheel; and an engagement portion disposed on an interior surface of a portion of the housing.

8. The washing machine device of claim 7, wherein, with the lock in the first position, the spring is in a compressed position, and the wheel is rotatable relative to the housing and the arm is pivotable about the housing.

9. The washing machine device of claim 7, wherein, with the lock in the second position, the spring exerts a force on the wheel towards the engagement portion thereby fixing the engagement portion within the plurality of teeth to lock the wheel relative to the housing and the arm relative to the housing.

10. The washing machine device of claim 7, wherein the wheel includes a first side having the plurality of teeth and a second side defining a spring receiving aperture, the spring received within the spring receiving aperture.

11. The washing machine device of claim 7, wherein the lock includes three springs.

12. The washing machine device of claim 7, wherein the engagement portion comprises a plurality of protruding ribs.

13. The washing machine device of claim 1, wherein the arm is pivotable greater than 180 degrees relative to the housing.

14. The washing machine device of claim 1, wherein the arm is pivotable greater than 230 degrees relative to the housing.

15. The washing machine device of claim 1, wherein the base includes a bottom surface having an adhesive.

16. The washing machine device of claim 1, further comprising a receiving ring attached to an interior surface of the door, wherein, with the base secured to the surface of the washing machine, the second end of the arm contacts a portion of the receiving ring to hold the door of the washing machine open.

17. The washing machine device of claim 16, wherein the second end of the arm includes a magnet.

* * * * *